US011798440B1

(12) United States Patent
You

(10) Patent No.: US 11,798,440 B1
(45) Date of Patent: Oct. 24, 2023

(54) ONLINE MANAGEMENT PIXEL LAMP SCREEN

(71) Applicant: Shanghai Edge Light Industry Co., Ltd., Shanghai (CN)

(72) Inventor: Lei You, Shanghai (CN)

(73) Assignee: Shanghai Edge Light Industry Co., Ltd., Shanghai (CN)

( * ) Notice: Subject to any disclaimer, the term of this patent is extended or adjusted under 35 U.S.C. 154(b) by 0 days.

(21) Appl. No.: 17/991,635

(22) Filed: Nov. 21, 2022

(30) Foreign Application Priority Data

Jun. 27, 2022 (CN) ..... 202210734694.6

(51) Int. Cl.
*G09F 9/33* (2006.01)
*G09G 3/32* (2016.01)

(52) U.S. Cl.
CPC ..... *G09F 9/335* (2021.05); *G09G 3/32* (2013.01); *G09G 2300/04* (2013.01)

(58) Field of Classification Search
CPC ..... G09F 9/335; G09G 3/32; G09G 2300/04
See application file for complete search history.

(56) References Cited

U.S. PATENT DOCUMENTS

2021/0274722 A1* 9/2021 Tracy ..... F21V 23/06

* cited by examiner

*Primary Examiner* — Anne M Hines
(74) *Attorney, Agent, or Firm* — Zhu Lehnhoff LLP

(57) ABSTRACT

The present invention discloses an online management pixel lamp screen, comprising a back plate. A pixel lamp screen controllable light-emitting module board is fixedly mounted on one side of the back plate, multiple press switches arranged at equal distances are arranged on one side of the pixel lamp screen controllable light-emitting module board away from the back plate, three lamp beads are fixedly mounted on the periphery of the press switch, a back guide post module is arranged on the other side of the pixel lamp screen controllable light-emitting module board, a pixel lamp screen housing is sleeved around the back guide post module, and the pixel lamp screen housing comprises a first strong magnet. In the present invention, the lamp bead can be used to project light beams of different colors onto an acrylic bar so as to achieve the corresponding switching of on, off, and different colors of the lamp bead, thereby realizing the effect of diversified display modes. The device has low production cost and low energy consumption; at the same time, an advertising lamp box has multiple modes, which are applicable to different occasions and different levels of personnel.

5 Claims, 6 Drawing Sheets

ONLINE MANAGEMENT PIXEL LAMP SCREEN

The present application claims the priority of Chinese Patent Application No. 202210734694.6, field on Jun. 27, 2022, the disclosure of which is hereby incorporated by reference.

TECHNICAL FIELD

The present invention belongs to the field of lamps and particularly relates to an online management pixel lamp screen.

BACKGROUND

An LED pixel lamp is an intelligent lamp that can replace a display screen of a certain specification by pixel point color mixing to achieve the effect of "from point to surface". However, the existing LED pixel lamp does not have the effect of diversified display. At the same time, in the process of using a pixel lamp, the problem of a single mode exists, which cannot be applied to different occasions and scenarios, and most of the existing pixel lamps are expensive. In order to solve the above problems, an online management pixel lamp screen is proposed.

SUMMARY OF THE INVENTION

It is an object of the present invention to provide an online management pixel lamp screen to address the above-mentioned deficiencies in the art.

In order to achieve the above object, the present invention provides the following technical solutions: an online management pixel lamp screen comprising a back plate is disclosed. A pixel lamp screen controllable light-emitting module board is fixedly mounted on one side of the back plate, multiple press switches arranged at equal distances are provided on one side of the pixel lamp screen controllable light-emitting module board away from the back plate, three lamp beads are fixedly mounted around the press switch, a back guide post module is provided on the other side of the pixel lamp screen controllable light-emitting module board, and a pixel lamp screen housing is sleeved around the back guide post module; the pixel lamp screen housing comprises a first strong magnet, a second strong magnet, a spring lock, and a fixed frame, wherein the first strong magnet and the second strong magnet are arranged on a peripheral surface of the fixed frame, an S pole of the first strong magnet is beyond an outside, an N pole of the second strong magnet is beyond the outside, and the spring lock) is arranged on the bottom surface of the fixed frame.

As a preferred solution of the present invention, the spring lock further comprises a first locking block, a locking plate, a first spring seat, a spring, a plug pin, a second spring seat, a locking ring, and a second locking block and, wherein one side of the second spring seat is fixedly connected to one end of the plug pin, and the other end is sleeved with one side of the second spring seat; the other side of the second spring seat is fixedly connected to one side of the locking ring, the spring is wound around an outer ring of the spring, one end of the plug pin away from the second spring seat is fixedly connected to one side of the first spring seat, and one end of the first spring seat away from the plug pin is fixedly connected to one end of the locking plate; one end of the first locking block and one end of the second locking block which are close to each other are respectively inserted into the locking plate and the locking ring.

As a preferred solution of the present invention, multiple acrylic bars are sleeved on one side of the pixel lamp screen housing, and the acrylic bar is generally transparent; the lamp bead on the pixel lamp screen controllable light-emitting module board emits different colors of light, and the light is introduced into the acrylic bar so that the acrylic bar displays different colors.

As a preferred solution of the present invention, the pixel lamp screen controllable light-emitting module board has multiple light-emitting modes which can be selected and controlled via an APP and can be divided into two categories, namely, a fixed mode and an adjustable mode, wherein the fixed mode comprises: RGBW full color monochromatic mode and press cycle mode; the adjustable mode comprises: addressable mode, animation effect library mode, and remote mode.

As a preferred solution of the present invention, the back guide post module is a plastic housing and appears as being matched with the pixel lamp screen housing.

In the above technical solution, the present invention provides the technical effects and advantages as follows.

In the present invention, the lamp bead can be used to project light beams of different colors onto an acrylic bar so as to achieve the corresponding switching of on, off, and different colors of the lamp bead, thereby realizing the effect of diversified display modes. The device has low production cost and low energy consumption; at the same time, an advertising lamp box has multiple modes, which are applicable to different occasions and different levels of personnel.

BRIEF DESCRIPTION OF THE DRAWINGS

In order to explain the embodiments of the present application or the technical scheme in the prior art more clearly, the following will briefly introduce the drawings that need to be used in the description of the embodiments. Obviously, the drawings in the following description are merely some embodiments recorded in the present invention. For those of ordinary skills in the art, other drawings can be obtained based on these drawings.

Figure 1:
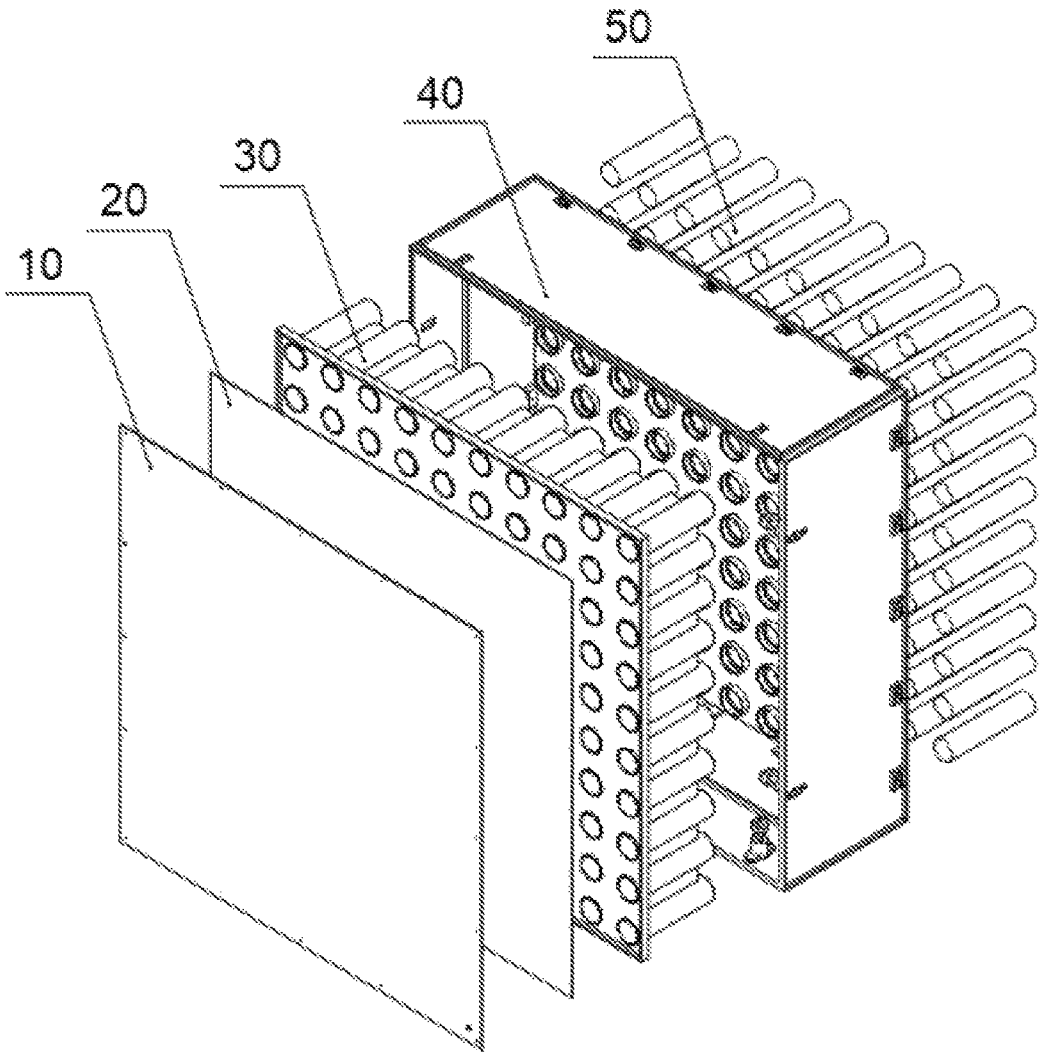
FIG. 1 is a schematic view of an exploded structure of an online management pixel lamp screen according to the present invention.

Description of Reference Numerals:

10. back plate; 20. pixel lamp screen controllable light-emitting module board; 21. press switch; 22. lamp bead; 30. back guide post module; 40. pixel lamp screen housing; 41. first strong magnet; 42. second strong magnet; 43. spring lock; 43-1. first locking block; 43-2. locking plate; 43-3. first spring seat; 43-4. spring; 43-5. plug pin; 43-6. second spring seat; 43-7. locking ring; 43-8. second locking block; 44. fixed frame; and 50. acrylic bar.

DETAILED DESCRIPTION OF THE PREFERRED EMBODIMENTS

In order to more clearly explain and illustrate the technical solutions and implementations of the present invention, several preferred specific embodiments for implementing the technical solutions of the present invention are described below.

The following description is merely exemplary in nature and is not intended to limit the present disclosure, application, or uses. It should be understood that throughout the drawings, the same or similar reference numerals indicate the same or similar parts and features. The various drawings only schematically represent the concepts and principles of the implementation modes of the present disclosure, and do not necessarily show the specific dimensions and scales of the various implementation modes of the present disclosure. Specific details or structures of the implementation modes of the present disclosure may be shown in exaggerated form in certain parts of certain drawings. With regard to various publications, patents, and published patent specifications referred to herein, the disclosures thereof are incorporated by reference in their entirety. The technical solutions of the present invention will be clearly and completely described below with reference to the embodiments of the present invention. Obviously, the described embodiments are only a part of the embodiments of the present invention.

In the description of the present invention, unless expressly specified or limited otherwise, the terms "first" and "second" are used for descriptive purposes only and are not to be construed as indicating or implying relative importance; unless otherwise specified or illustrated, the term "multiple" means two or more than two; the terms "connected", "fixed", and the like are to be construed broadly, e.g. "connected" can be either a fixed connection or a detachable connection; or can be directly connected or indirectly connected through an intermediary. For those of ordinary skills in the art, the specific meaning of the above-mentioned terms in the present invention can be understood according to specific circumstances.

In the description of the present description, it needs to be understood that orientations such as "up", "down", "left", and "right" described in the embodiments of the present application are described from the angles shown in the drawings, and should not be construed as limitations to the embodiments of the present application. In addition, in this context, it also needs to be understood that when it is mentioned that one element is connected to be 10 "on" or "under" another element, it can not only be directly connected to be "on" or "under" the other element, but also be indirectly connected to be "on" or "under" the other element through an intervening element.

Embodiment 1

Figure 2:
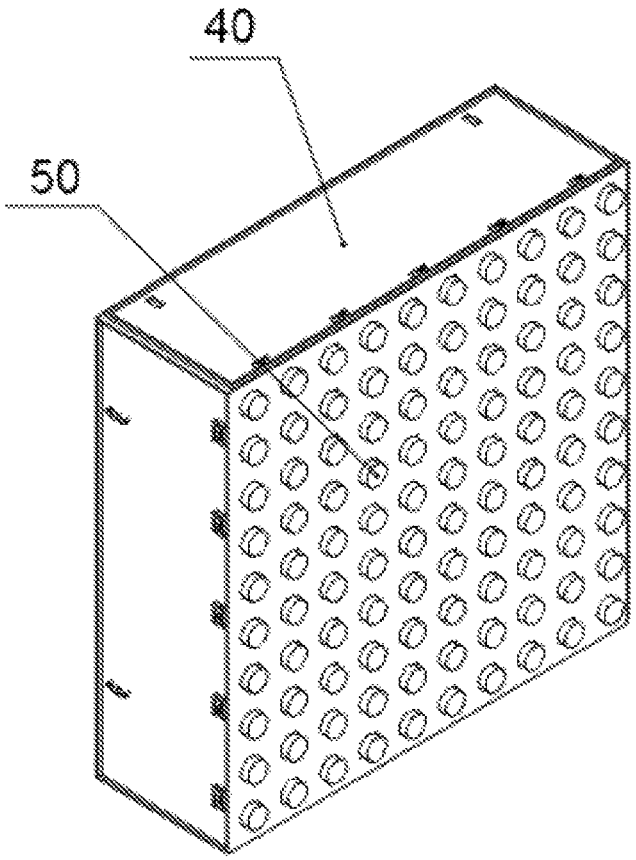
FIG. 2 is a schematic view of a stereostructure of an online management pixel lamp screen according to the present invention.
Figure 3:
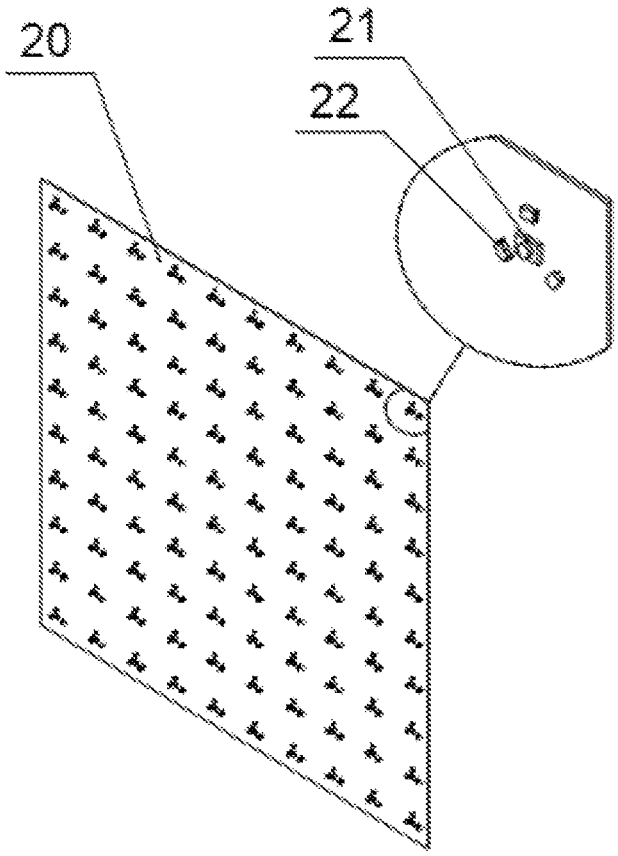
FIG. 3 is a schematic view of a pixel lamp screen controllable light-emitting module board structure of an online management pixel lamp screen according to the present invention.
Figure 4:
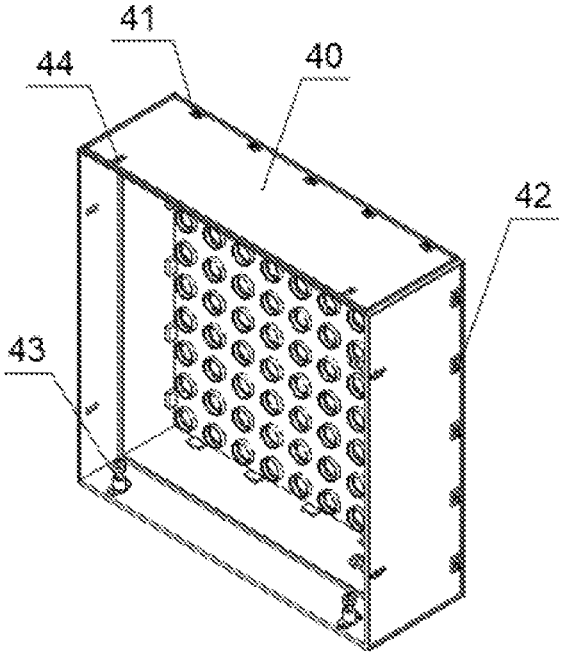
FIG. 4 is a schematic view showing a structure of a pixel lamp screen housing of an online management pixel lamp screen according to the present invention.
Figure 5:
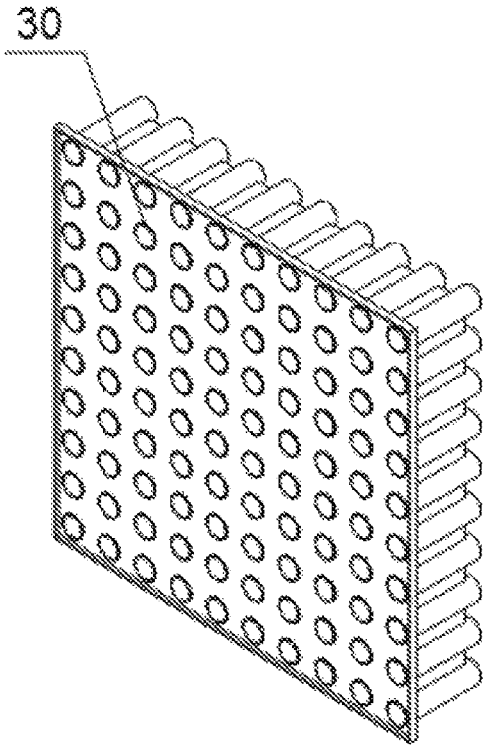
FIG. 5 is a schematic view showing a structure of a back guide post module of an online management pixel lamp screen according to the present invention.
Figure 6:
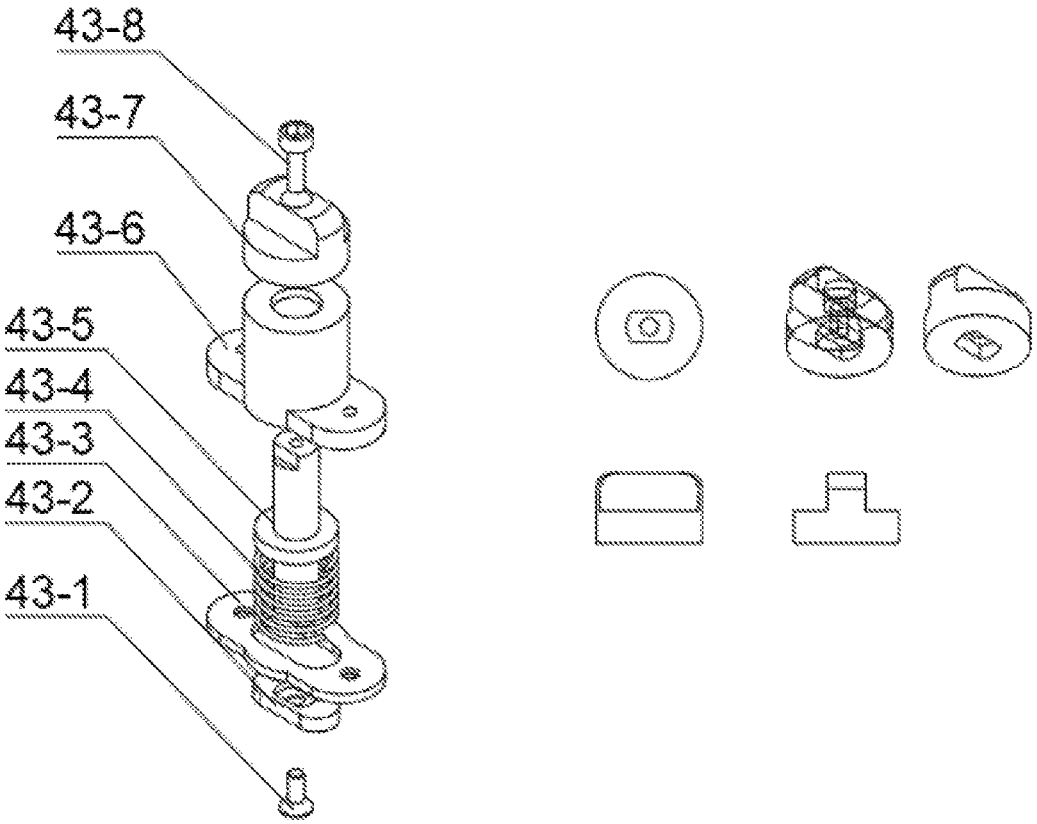
FIG. 6 is a schematic view showing a spring lock structure of an online management pixel lamp screen according to the present invention.
Figure 7:
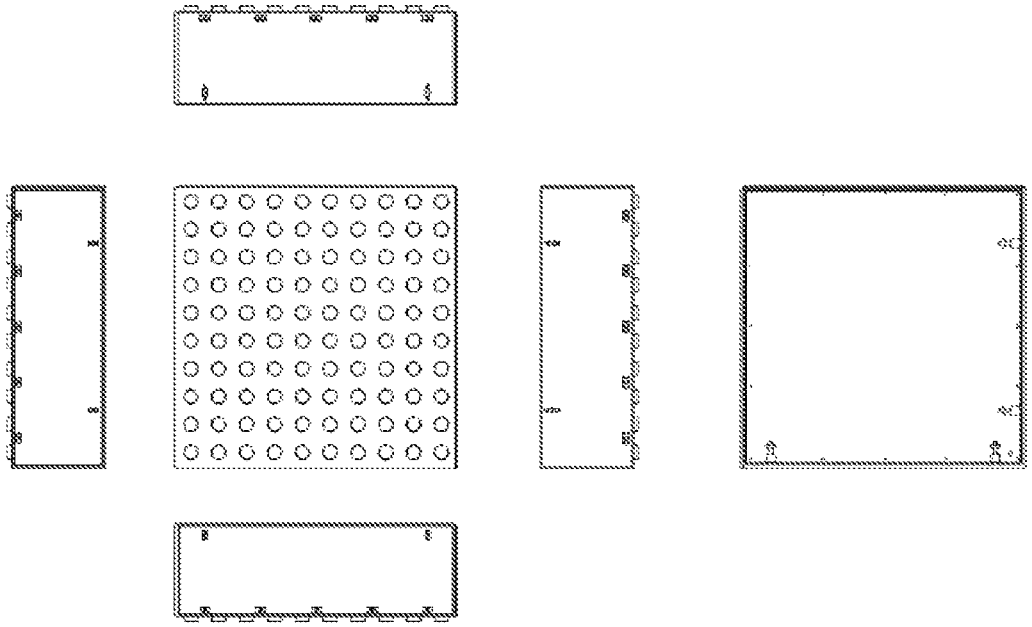
FIG. 7 is a schematic view showing an exploded structure of an online management pixel lamp screen according to the present invention.
Figure 8:
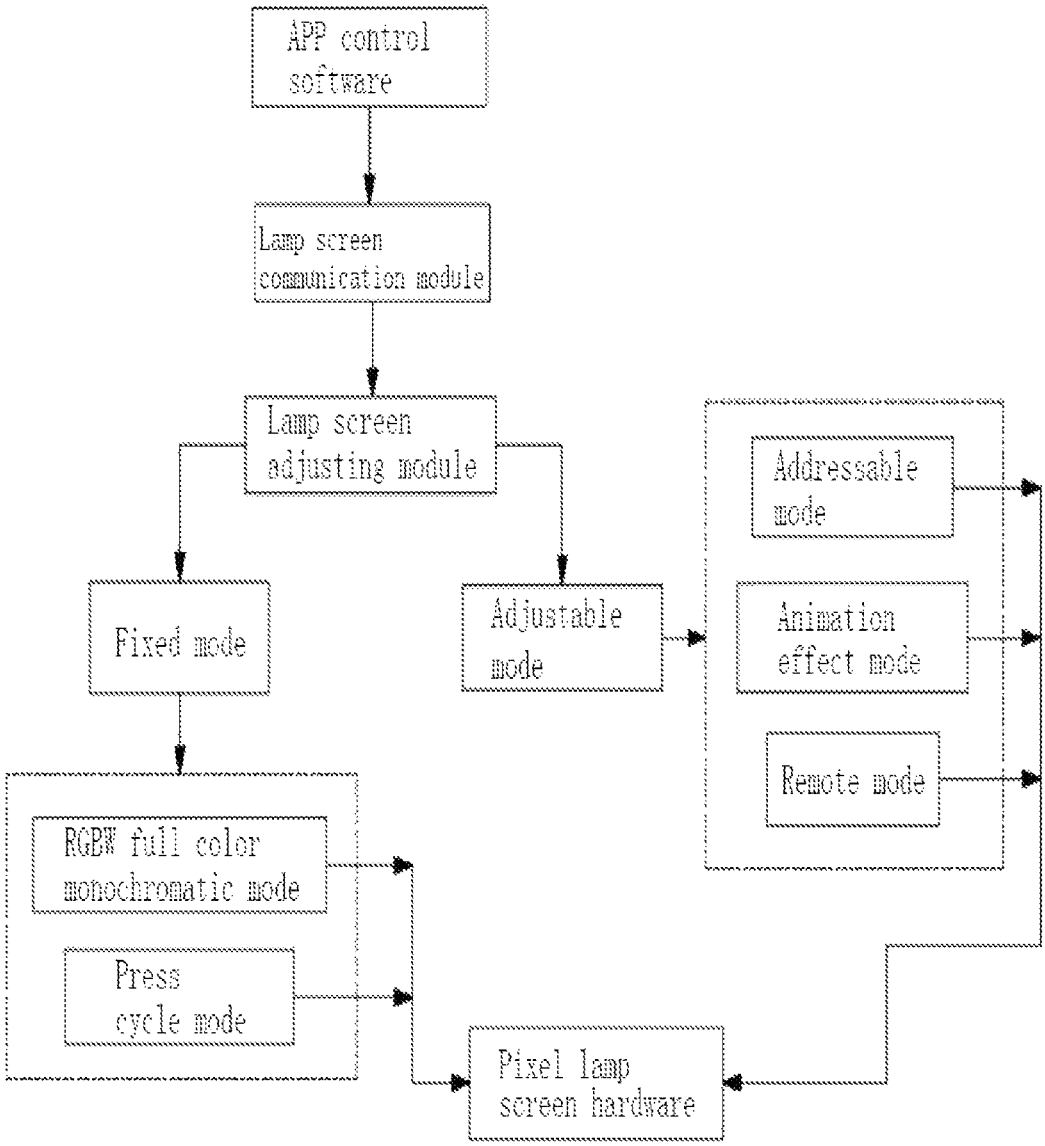
FIG. 8 is a schematic view of a mode adjusting flow of an online management pixel lamp screen according to the present invention.

With reference to FIGS. 1 to 8 of the description, an online management pixel lamp screen is disclosed, comprising a back plate 10, wherein a pixel lamp screen controllable light-emitting module board 20 is fixedly mounted on one side of the back plate 10, multiple press switches 21 arranged at equal distances are arranged on one side of the pixel lamp screen controllable light-emitting module board 20 away from the back plate 10, three lamp beads 22 are fixedly 20 mounted on the periphery of the press switch 21, a back guide post module 30 is arranged on the other side of the pixel lamp screen controllable light-emitting module board 20, and a pixel lamp screen housing 40 is sleeved around the back guide post module 30. The pixel lamp screen housing 40 comprises a first strong magnet 41, a second strong magnet 42, a spring lock 43, and a fixed frame 44, wherein the first strong magnet 41 and the second 25 strong magnet 42 are arranged on the peripheral surface of the fixed frame 44, the S pole of the first strong magnet 41 is beyond the outside, the N pole of the second strong magnet 42 is beyond the outside, and the spring lock 43 is arranged on the bottom surface of the fixed frame 44.

Embodiment 2

On the basis of embodiment 1, with reference to FIGS. 1-8 of the description, an online management pixel lamp screen is disclosed, wherein the spring lock 43 further comprises a first locking block 43-1, a locking plate 43-2, a first spring seat 43-3, a spring 43-4, a plug pin 43-5, a second spring seat 43-6, a locking ring 43-7, a second locking block 43-8 and 43-9. One side of the second spring seat 43-6 is fixedly connected to one end of the plug pin 43-5, the other end is sleeved with one side of the second spring seat 43-6, the other side of the second spring seat 43-6 is fixedly connected to one side of the locking ring 43-7, and the spring 43-4 is wound around the outer ring of the spring 43-4; one end of the plug pin 43-5 away from the second spring seat 43-6 is fixedly connected to one side of the first spring seat 43-3, one end of the first spring seat 43-3 away from the plug pin 43-5 is fixedly connected to one end of the locking plate 43-2, one ends of the first locking block 43-1 and the second locking block 43-8 close to each other are respectively inserted into the locking plate 43-2 and the locking ring 43-7, one side of the pixel lamp screen housing 40 is sleeved with multiple acrylic bars 50, and the acrylic bars 50 are usually transparent. The lamp bead 22 on the pixel lamp screen controllable light-emitting module board 20 emits different colors of light, and the light is introduced into the acrylic bar 50 to make the acrylic bar 50 display different colors. The pixel lamp screen controllable light-emitting module board 20 has various light-emitting modes, which can be selected and controlled through an APP. It can be divided into two categories: fixed mode and adjustable mode. The fixed mode includes: RGBW full color monochromatic mode and the press cycle mode; the adjustable mode includes: the addressable mode, the animation effect library mode and the remote mode. The back guide post module 30 is a plastic housing, and appears as being matched with the pixel lamp screen housing 40.

The APP selection and control of a light-emitting mode is operated and realized online via a lamp screen communication module and a lamp screen adjusting module provided on the pixel lamp screen controllable light-emitting module board 20. The lamp screen communication module and the lamp screen adjusting module are not shown in the drawings of the description, but a person skilled in the art could be able to know that the communication connection and control operation between such equipment can be realized by a conventional communication coupling and control logic circuit, which is not further limited herein.

The lamp screen control APP in the mobile terminal can integrate the simple lamp screen control function and display mode switching. The APP sends a control signal to a lamp screen adjusting module via a lamp screen communication module. The lamp screen adjusting module performs logic processing on the display content and display mode of the lamp screen, and can further optimize the display effect by means of point-by-point correction. Namely, by collecting brightness and chroma data of each pixel region on the screen, a correction coefficient of each primary color sub-pixel or a correction coefficient matrix of each pixel is given. The same is fed back to the lamp screen adjusting module, and then the lamp screen communication module realizes the communication with the mobile terminal APP, and the APP can realize differential driving on each pixel by controlling the correction coefficient.

Specific light-emitting modes include but are not limited to the fixed mode and the adjustable mode. The fixed mode comprises a RGBW full color monochromatic mode, a press cycle mode, etc.; the adjustable mode includes an addressable mode, an animation effect library mode, a remote mode, etc. The RGBW full color monochromatic mode refers to directly writing an image algorithm in a lamp screen adjusting module through a RGBW pixel fusion unit configured on the pixel lamp screen controllable light-emitting module board 20, so that the algorithm can run and calculate in the lamp screen adjusting module in advance, thereby providing the operation and implementation of the RGBW display mode. Compared with the Bayer array RGGB, RGBW replaces the G (green) sub-pixel in the RGGB as a W (white) sub-pixel, so that the light-emitting mode can enhance the display effect to some extent, especially when ambient light conditions are poor. Certainly, the degree of enhancement is still limited by the level of hardware configuration. The press cycle mode can be realized by providing a shortcut key of the mobile terminal in the APP; for some contents and scenarios needing to be displayed cyclically, operations such as cyclic display by one key or stopping display can be realized by providing a shortcut key of the mobile terminal; a cyclic display parameter can also be set in the APP interface, including the number of cyclic display times, etc. so as to meet the requirements of display control flexibility to the maximum extent. The addressable mode is to realize the display control of a specific addressing area by providing an addressing matrix of the pixel lamp screen controllable light-emitting module board 20. The addressing matrix is an array of pixel positions characterizing a specific shape or a specific area of the pixel lamp screen controllable light-emitting module board 20, and can be selected and operated from the APP interface by being saved into the lamp screen adjusting module in advance. The animation effect library mode needs to pre-set specific animation effect materials in the mobile terminal, and displays the same in the pixel lamp screen controllable light-emitting module board 20 after performing color selection and content rendering in the APP interface. The mobile terminal can also download animation effects online for use. The remote mode allows the screen of the mobile terminal to be directly projected onto the pixel lamp screen controllable light-emitting module board 20; however, this mode occupies the screen of the mobile terminal, and the distance of the remote screen projection is limited by the constraints of the on-site communication mode. For example, when the mobile terminal and the lamp screen communication module are connected by using Bluetooth, the screen projecting distance is greatly limited, and this mode is mainly suitable for scenarios with relatively fixed light-emitting mode and display content; however, under the communication system and technical architecture disclosed in the present invention, the APP of the mobile terminal can still develop more practical operation functions and more interfaces and hardware can be configured on the pixel lamp screen controllable light-emitting module board 20, making it an open-source, compatible light-emitting display platform.

Working Principles of the Invention:

with reference to FIGS. 1 to 8 of the description, the pixel lamp screen housing 40 is a plastic housing, which can be a rectangle or other polygonal, special-shaped, etc.; the pixel lamp screen controllable light-emitting module board 20 has multiple light-emitting modes, which can be selected and controlled by means of the APP, and can be divided into two categories: a fixed mode and an adjustable mode; the fixed mode comprises: RGBW full color monochromatic mode and press cycle mode; the adjustable modes comprises: an addressable mode, an animation effect library mode, and a remote mode; the pixel lamp screen is conventionally a standard module which can also be a whole block, and a large size is generally formed by combining several standard modules which are fixed together by means of a specific combination structure and a first strong magnet 41 and a second strong magnet 42 and a spring lock 43; an acrylic bar 50 is usually transparent; the lamp bead 22 on the pixel lamp screen controllable light-emitting module board 20 emits different colors of light, and the light is introduced into the acrylic bar 50 so that the acrylic bar 50 displays different colors; the press switch 21 on the module board is touched via the acrylic bar 50 so that, correspondingly, the lamp bead 22 can be switched between on, off, and different colors; one press switch is provided on the module board corresponding to each hole on the pixel lamp screen housing 40, which can realize the above functions.

Certain exemplary embodiments of the present description have been described above by way of illustration only, and it is needless to say that for those skilled in the art, the described embodiments may be modified in various different ways without departing from the spirit and scope of the present invention. Accordingly, the drawings and description are to be regarded as illustrative in nature, and not as restrictive on the scope of the claims of the present invention.

The invention claimed is:

1. An online management pixel lamp screen, comprising a back plate (10), characterized in that a pixel lamp screen controllable light-emitting module board (20) is fixedly mounted on one side of the back plate (10), multiple press switches (21) arranged at equal distances are provided on one side of the pixel lamp screen controllable light-emitting module board (20) away from the back plate (10), three lamp beads (22) are fixedly mounted around the press switch (21), a back guide post module (30) is provided on the other side of the pixel lamp screen controllable light-emitting module board (20), and a pixel lamp screen housing (40) is sleeved around the back guide post module (30); the pixel lamp screen housing (40) comprises a first strong magnet (41), a second strong magnet (42), a spring lock (43), and a fixed frame (44), wherein the first strong magnet (41) and the second strong magnet (42) are arranged on a peripheral surface of the fixed frame (44), an S pole of the first strong magnet (41) faces an outside of the pixel lamp screen housing, an N pole of the second strong magnet (42) faces the outside of the pixel lamp screen housing, and the spring lock (43) is arranged on a bottom surface of the fixed frame (44).

2. The online management pixel lamp screen according to claim 1, characterized in that the spring lock (43) further comprises a first locking block (43-1), a locking plate (43-2), a first spring seat (43-3), a spring (43-4), a plug pin (43-5), a second spring seat (43-6), a locking ring (43-7), and a second locking block (43-8) and (43-9), wherein one side of the second spring seat (43-6) is fixedly connected to one end of the plug pin (43-5), and the other end is sleeved with one side of the second spring seat (43-6); the other side of the second spring seat (43-6) is fixedly connected to one side of the locking ring (43-7), the spring (43-4) is wound around an outer ring of the spring (43-4), one end of the plug pin (43-5) away from the second spring seat (43-6) is fixedly connected to one side of the first spring seat (43-3), and one end of the first spring seat (43-3) away from the plug pin (43-5) is fixedly connected to one end of the locking plate (43-2); one end of the first locking block (43-1) and one end of the second locking block (43-8) which are close to each other are respectively inserted into the locking plate (43-2) and the locking ring (43-7).

3. The online management pixel lamp screen according to claim 1, characterized in that multiple acrylic bars (50) are sleeved on one side of the pixel lamp screen housing (40), and the acrylic bar (50) is generally transparent; the lamp bead (22) on the pixel lamp screen controllable light-emitting module board (20) emits different colors of light, and the light is introduced into the acrylic bar (50) so that the acrylic bar (50) displays different colors.

4. The online management pixel lamp screen according to claim 1, characterized in that the pixel lamp screen controllable light-emitting module board (20) has multiple light-emitting modes which can be selected and controlled via an app and can be divided into two categories, namely, a fixed mode and an adjustable mode, wherein the fixed mode comprises: an RGBW (red, green, blue and white) full color monochromatic mode and a press cycle mode; the adjustable mode comprises: an addressable mode, an animation effect library mode, and a remote mode.

5. The online management pixel lamp screen according to claim 1, characterized in that the back guide post module (30) is a plastic housing and is fitted into the pixel lamp screen housing (40).

* * * * *